US009483009B1

(12) United States Patent
Saito et al.

(10) Patent No.: US 9,483,009 B1
(45) Date of Patent: Nov. 1, 2016

(54) IMAGE FORMING APPARATUS

(71) Applicant: KYOCERA Document Solutions Inc., Osaka (JP)

(72) Inventors: Yosuke Saito, Osaka (JP); Shigeki Tsukahara, Osaka (JP); Ai Takagami, Osaka (JP); Masaki Kadota, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/892,384

(22) PCT Filed: Feb. 19, 2015

(86) PCT No.: PCT/JP2015/054623
§ 371 (c)(1),
(2) Date: Nov. 19, 2015

(87) PCT Pub. No.: WO2015/141372
PCT Pub. Date: Sep. 24, 2015

(30) Foreign Application Priority Data

Mar. 20, 2014 (JP) ..... 2014-057904

(51) Int. Cl.
*G03G 21/00* (2006.01)
*G03G 21/06* (2006.01)
*G03G 15/00* (2006.01)

(52) U.S. Cl.
CPC ..... *G03G 15/75* (2013.01); *G03G 21/0005* (2013.01); *G03G 21/06* (2013.01)

(58) Field of Classification Search
CPC ..... G03G 15/75
USPC ..... 399/343, 96, 128, 129
See application file for complete search history.

(56) References Cited

U.S. PATENT DOCUMENTS 9,141,072 B2 * 9/2015 Gyotoku ..... G03G 21/0064
9,354,584 B2 * 5/2016 Takagami ..... G03G 21/0094

FOREIGN PATENT DOCUMENTS

JP 2000-127489 A 5/2000
JP 2007-210137 A 8/2007
JP 2007-219117 A 8/2007
JP 2007-264167 A 10/2007
JP 2008-026441 A 2/2008
JP 2008-058938 A 3/2008

OTHER PUBLICATIONS

International Search Report—PCT/JP2015/054623 mailed Apr. 21, 2015.

* cited by examiner

*Primary Examiner* — Susan Lee
(74) *Attorney, Agent, or Firm* — Studebaker & Brackett PC

(57) ABSTRACT

An image forming apparatus (100) forms an image on a recording medium. The image forming apparatus (100) includes a substrate (161), a photosensitive drum (120), a heating element (163) that heats the photosensitive drum (120), a light emitting element (162) that performs static elimination on the photosensitive drum (120), and a metal member (167) that transfers heat from the heating element (163) to the photosensitive drum (120). The light emitting element (162) and the heating element (163) are mounted on one of main surfaces of the substrate (161). The metal member (167) is in contact with another of the main surface of the substrate (161).

9 Claims, 5 Drawing Sheets

IMAGE FORMING APPARATUS

TECHNICAL FIELD

The present invention relates to image forming apparatuses.

BACKGROUND ART

Image forming apparatuses utilizing electrophotographic processes form an electrostatic latent image on a surface of a photosensitive drum and develop the electrostatic latent image into a toner image for visualization. Such an image forming apparatus includes a static eliminator for eliminating static electricity and an electrostatic latent image that remain redundantly on the surface of the photosensitive drum. The static eliminator performs static elimination by irradiating the surface of the photosensitive drum with light.

In view of environmental friendliness, amorphous silicon, which is excellent in abrasion resistance and durable under long-term use, is used generally in the photosensitive drum. Amorphous silicon has a surface having a molecular structure that is apt to adsorb moisture. As a result, moisture is liable to be adsorbed into the surface of the photosensitive drum. When moisture is adsorbed into the surface of the photosensitive drum, the surface resistance of the photosensitive drum may decrease, thereby reducing the surface potential at an edge of the electrostatic latent image. As a result, image quality may degrade.

In view of the foregoing, it has been proposed to provide in the vicinity of the photosensitive drum, a substrate on which a heating element that heats the surface of the photosensitive drum is mounted (e.g., Patent Literature 1). In an image forming apparatus recited in Patent Literature 1, a light emitting element that eliminates static electricity on the photosensitive drum is mounted on one of main surfaces of the substrate while the heating element that heats the photosensitive drum is mounted on the other main surface of the substrate.

CITATION LIST

Patent Literature

[Patent Literature 1]
Japanese Patent Application Laid-Open Publication No. 2007-264167

SUMMARY OF INVENTION

Technical Problem

However, in the image forming apparatus of Patent Literature 1, in which the light emitting element is mounted on one of the main surfaces of the substrate and the heating element is mounted on the other main surface of the substrate, wiring patterns are formed on the respective opposite surfaces of the substrate, resulting in an increase in man-hour for design. Further, the light emitting element is provided close to the photosensitive drum and the heating element is provided on the opposite side to the light emitting element. Therefore, the surface of the photosensitive drum may be heated insufficiently. This may hinder prevention of degradation of image quality caused due to image deletion in a high moisture environment.

The present invention has been made in view of the aforementioned problems and has its objective of providing an image forming apparatus in which degradation of image quality caused due to image deletion in a high humidity environment can be prevented.

Solution to Problem

An image forming apparatus according to the present invention is an image forming apparatus that forms an image on a recording medium. The image forming apparatus includes a substrate, a photosensitive drum, a heating element that heats the photosensitive drum, a light emitting element that performs static elimination on the photosensitive drum, and a metal member that transfers heat from the heating element to the photosensitive drum. The light emitting element and the heating element are mounted on one of main surfaces of the substrate. The metal member is in contact with another of the main surfaces of the substrate.

Advantageous Effects of Invention

According to the present invention, an image forming apparatus can be provided in which degradation of image quality caused due to image deletion in a high humidity environment can be prevented.

DESCRIPTION OF EMBODIMENTS

Figure 1:
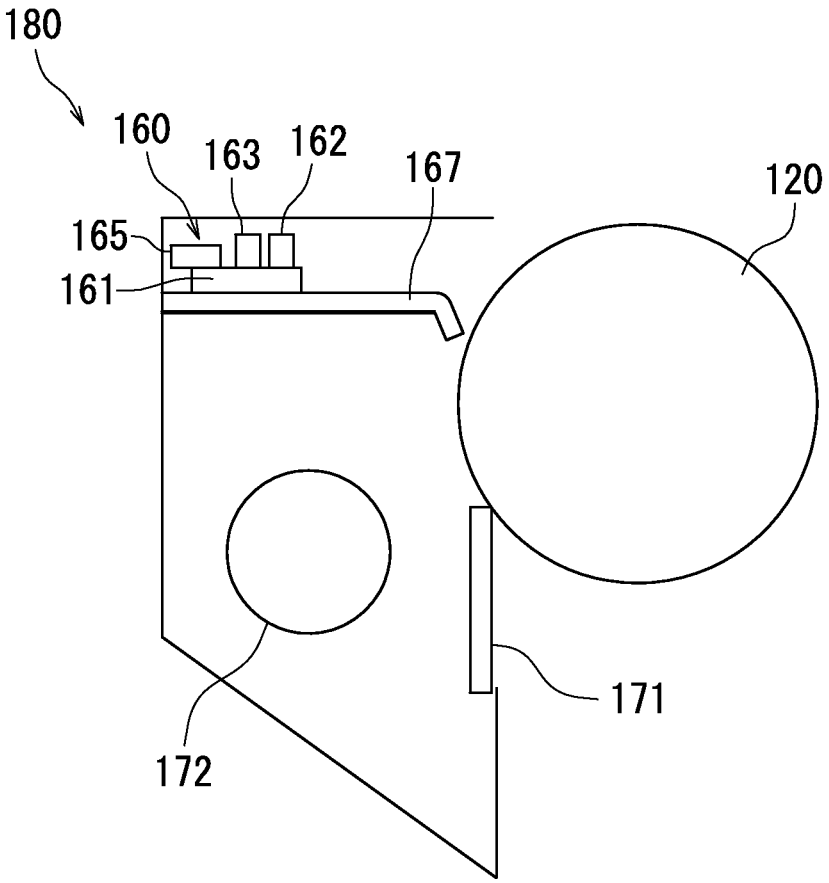
FIG. 1 illustrates a cleaner with a static eliminator according to an embodiment.

Hereinafter, an embodiment of the present invention will be described with reference to the accompanying drawings. Note that elements that are the same or equivalent are indicated by the same reference signs in the drawings and description thereof is not repeated.

FIG. 1 illustrates a cleaner 180 according to the present embodiment. The cleaner 180 includes a static eliminator 160. The static eliminator 160 eliminates static electricity remaining on the surface of a photosensitive drum 120. The static eliminator 160 includes a substrate 161, light emitting elements 162, heating elements 163, substrate warping restraining members 165, and a metal member 167. The light emitting elements 162 eliminate static electricity from the photosensitive drum 120 by irradiating the surface of the photosensitive drum 120 with light. The heating elements 163 heat the photosensitive drum 120 for evaporating moisture on the surface of the photosensitive drum 120. Both the light emitting elements 162 and the heating elements 163 are mounted on one of main surfaces of the substrate 161. The light emitting elements 162 are disposed in parallel to the heating elements 163 in the longitudinal direction of the photosensitive drum 120. The metal member 167 is in contact with the other main surface of the substrate 161 (a surface on which neither the light emitting elements 162 nor the heating elements 163 are mounted). In the configuration in which the light emitting elements 162 and the heating elements 163 are mounted on the same main surface of the substrate 161, a man-hour for wiring pattern design can be reduced and the light emitting elements 162 and the heating elements 163 can be mounted at low cost. Moreover, parallel arrangement of the light emitting elements 162 and the heating elements 163 can further reduce the man-hour for design.

The metal member 167 transfers heat from the heating elements 163 to the surface of the photosensitive drum 120. Even in a configuration in which the substrate 161 on which the heating elements 163 are mounted is located away from the surface of the photosensitive drum 120, the arrangement of the metal member 167 in the vicinity of the surface of the photosensitive drum 120 can result in efficient heating of the surface of the photosensitive drum 120.

The metal member 167 is disposed such that an end part of the metal member 167 located closest to the photosensitive drum 120 is disposed closer to the photosensitive drum 120 than an end part of the substrate 161 located closest to the photosensitive drum 120. The metal member 167 accordingly reflects light from the light emitting elements 162 and irradiates the surface of the photosensitive drum 120 with the reflected light. Further, through the metal member 167, efficient transfer of heat from the heating elements 163 to the surface of the photosensitive drum 120 can be achieved.

The substrate warping restraining members 165 restrain the substrate 161 from warping caused by heat of the heating elements 163 and can reduce warping of the substrate 161. The substrate warping restraining members 165 extend in the longitudinal direction of the substrate 161. A material of the substrate warping restraining members 165 is not limited specifically as long as it is an insulating material and may preferably be resin among insulating materials.

The cleaner 180 further includes a cleaning blade 171 and a toner collecting screw 172. The cleaning blade 171 scrapes toner remaining on the surface of the photosensitive drum 120. The toner collecting screw 172 conveys the scraped toner to an end part of a toner collecting path.

Figure 2:
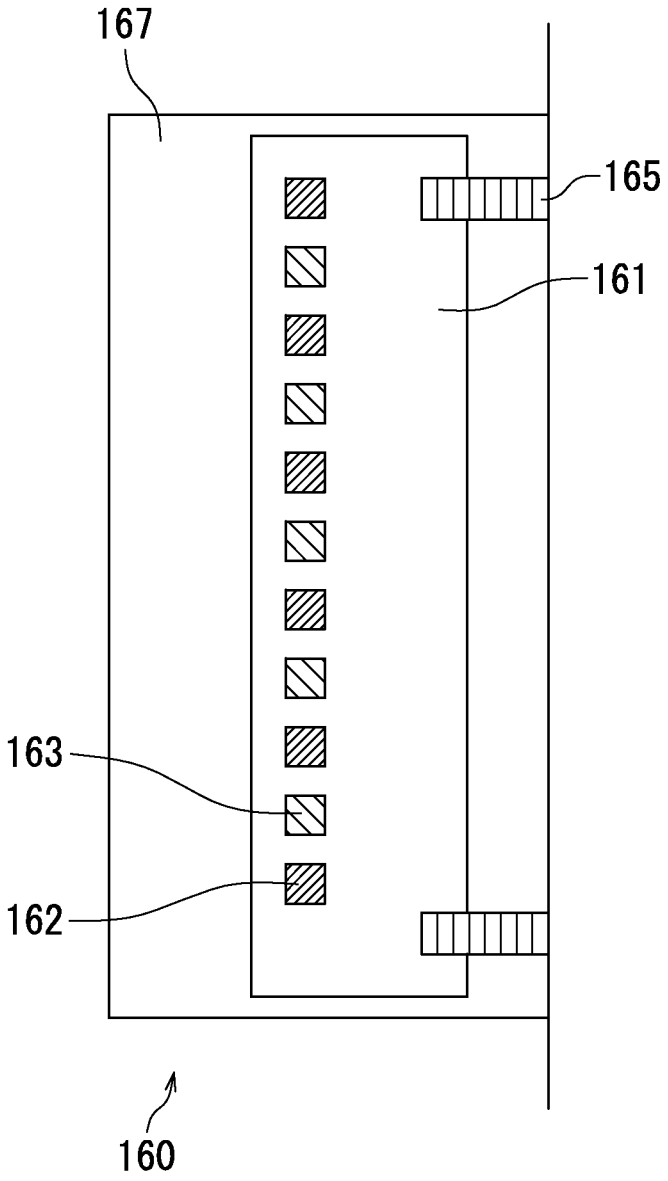
FIG. 2 illustrates an arrangement of heating elements and light emitting elements on a substrate according to an embodiment.

FIG. 2 illustrates an arrangement of the heating elements 163 and the light emitting elements 162 on the substrate 161 according to the present embodiment. The light emitting elements 162, the heating elements 163, and the substrate warping restraining members 165 are mounted on one of the main surfaces of the substrate 161. Further, the metal member 167 is in contact with the other main surface of the substrate 161.

The substrate warping restraining members 165 are preferably disposed at respective opposite end parts of the substrate 161. In the above configuration, the substrate warping restraining members 165 extend in a direction perpendicular to the longitudinal direction of the substrate 161.

Note that the light emitting elements 162 and the heating elements 163 may be disposed in an alternating manner in a straight line in the longitudinal direction of the photosensitive drum 120, as illustrated in FIG. 2 and different from FIG. 1.

Figure 3:
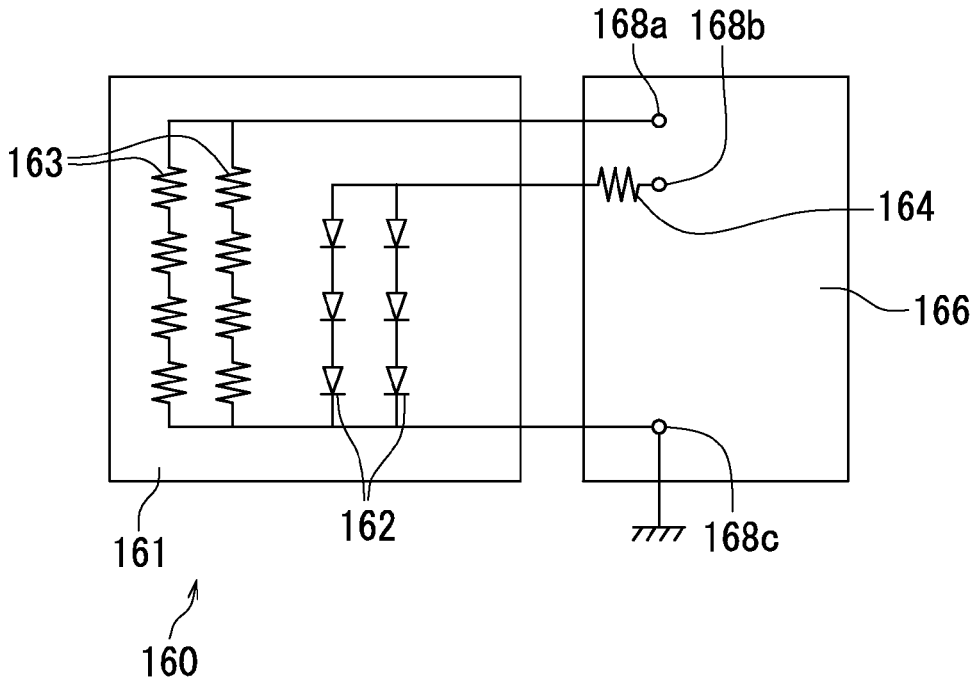
FIG. 3 is a circuit diagram of the static eliminator according to an embodiment.

FIG. 3 is a circuit diagram of the static eliminator 160 according to the present embodiment. In an image forming apparatus 100, the light emitting elements 162 may be light emitting diodes, for example. The heating elements 163 may be resistance elements, for example. The static eliminator 160 may further include a control board 166. The control board 166 includes electricity receiving terminals 168*a* and 168*b* for input and an electricity receiving terminal 168*c* for output. Electric power is supplied to the light emitting elements 162 and the heating elements 163 through the electricity receiving terminals 168*b* and 168*a*, respectively. Two or more series circuits are each constituted by one or more light emitting elements 162. These series circuits are connected together in parallel. Two or more series circuits are each constituted by one or more heating elements 163. These series circuits are connected together in parallel. One end of the parallel circuit of the light emitting elements 162 and one end of a parallel circuits of the heating elements 163 are connected to the electricity receiving terminals 168*b* and 168*a*, respectively. The other end of each of the parallel circuits thereof is connected to the electricity receiving terminal 168*c*. Note that the electricity receiving terminals 168*a*, 168*b*, and 168*c* are not limited specifically and may be through holes or connectors.

Referring to FIG. 3, the parallel circuits of the light emitting elements 162 and the heating elements 163 are wired separately from each other on an input side and connected through common wiring on the output side. In the above circuitry of the static eliminator 160, the light emitting elements 162 and the heating elements 163 can be turned on and off independently of each other. For example, the heating elements 163 can be turned off even in a state in which the light emitting elements 162 are turned on for static elimination on the photosensitive drum 120. Undesirable heating of the surface of the photosensitive drum 120 can be reduced in static elimination on the surface of the photosensitive drum 120 by the light emitting elements 162. As a result, excellent image quality can be attained. Further, the light emitting elements 162 and the heating elements 163 are connected through common wiring on the output side, thereby simplifying the circuitry. Separation of the substrate 161 and the control board 166 can reduce the size of the substrate 161, thereby reducing the size of the static eliminator 160.

The control board 166 includes a limiting resistor 164. The limiting resistor 164 controls a current value of the light emitting elements 162. Through the limiting resistor 164 controlling the current value of the light emitting elements 162, the amount of light that the light emitting elements 162 emit is adjusted. If the limiting resistor 164 is disposed on the substrate 161, heat of the limiting resistor 164 heats the substrate 161. As a result, the photosensitive drum 120 is heated by the heat of the limiting resistor 164 during static elimination on the photosensitive drum 120 by the light emitting elements 162.

Figure 4:
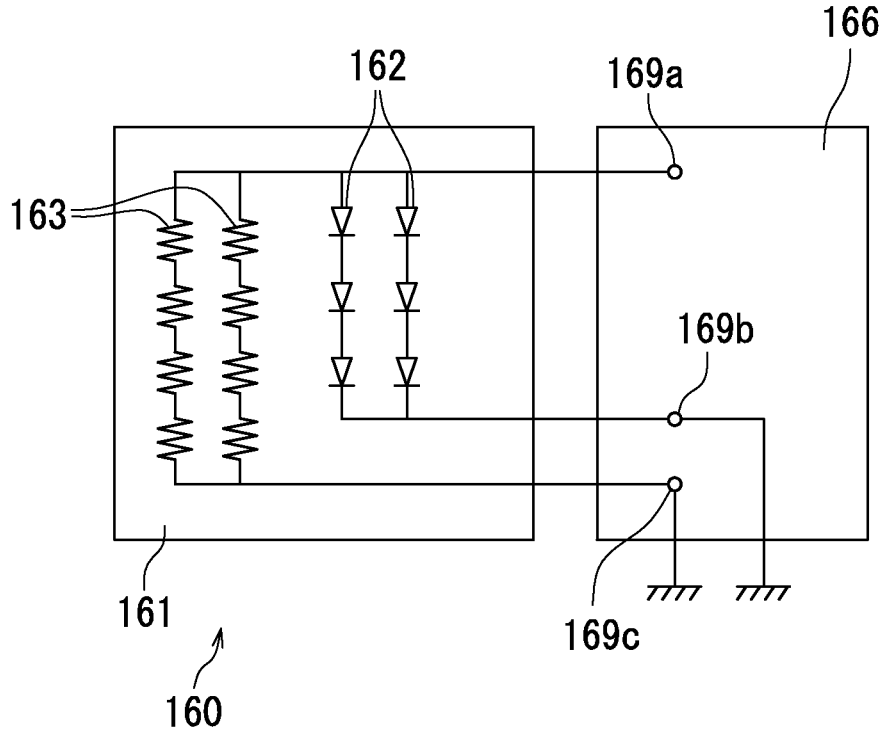
FIG. 4 is another circuit diagram of the static eliminator according to an embodiment.

FIG. 4 is another circuit diagram of the static eliminator 160 according to the present embodiment. The control board 166 includes an electricity receiving terminal 169*a* for input and electricity receiving terminals 169*b* and 169*c* for output. In FIG. 4, the circuitry of the static eliminator 160 is substantially the same as in FIG. 3 except that the light emitting elements 162 and the heating elements 163 are connected through common wiring on the input side while being wired separately from each other on the output side. In the above circuitry of the static eliminator 160, the same advantages as those obtained in FIG. 3 can be obtained. Further, in comparison between the configuration in which the light emitting elements 162 and the heating elements 163 are connected through common wiring on the input side and the configuration in which the light emitting elements 162 and the heating elements 163 are wired separately from each other on the input side, the circuitry is simple and the substrate 161 can be reduced in size in the configuration in which the light emitting elements 162 and the heating elements 163 are connected through common wiring.

It is noted that the respective circuitries of the static eliminator 160 illustrated in FIGS. 3 and 4 are applicable to the configurations as described with reference to FIG. 1 in which the light emitting elements 162 are disposed in parallel to the heating elements 163 in the longitudinal direction of the photosensitive drum 120 and FIG. 2 in which the light emitting elements 162 and the heating elements 163 are disposed in an alternate manner in a straight line in the longitudinal direction of the photosensitive drum 120.

Figure 5:
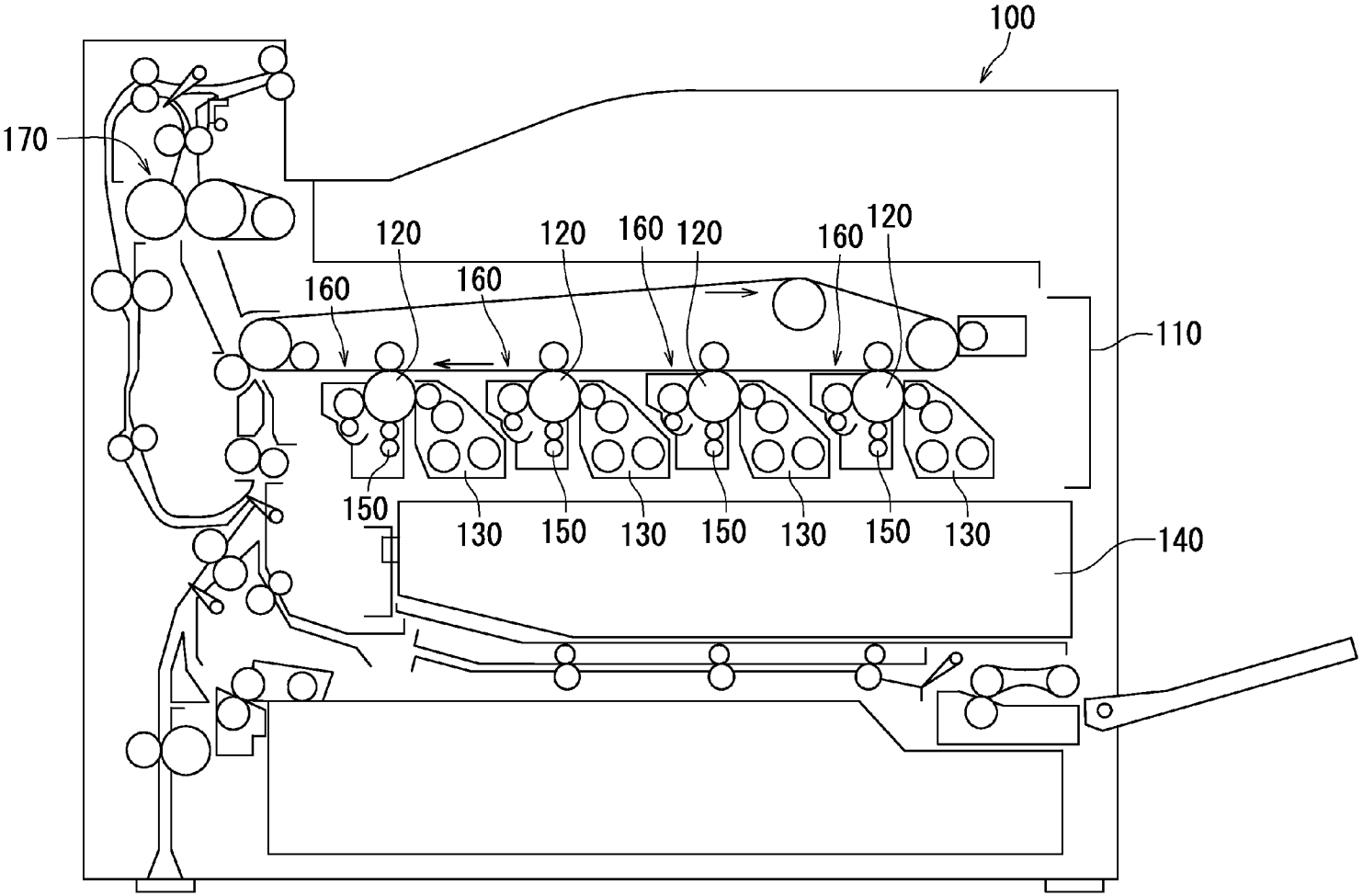
FIG. 5 is a cross sectional view illustrating an internal configuration of an image forming apparatus according to an embodiment.

FIG. 5 is a cross sectional view illustrating an internal configuration of the image forming apparatus 100 according to the present embodiment. The image forming apparatus 100 includes a plurality of the static eliminators 160 and an image forming section 110.

The image forming section 110 includes a plurality of the photosensitive drums 120, developing devices 130, an exposure device 140, chargers 150, and a fixing device 170. The image forming apparatus 100 may be a printer, for example. The image forming section 110 forms an image on a sheet. The static eliminators 160 each eliminate static electricity remaining on the surface of a corresponding one of the photosensitive drums 120. Note that the static eliminators 160 have been already described with reference to FIGS. 1-4. Therefore, detailed description thereof is omitted.

In image formation, the photosensitive drums 120 rotate counterclockwise and the chargers 150 each electrostatically charge the surface of corresponding one of the photosensitive drums 120 uniformly. The exposure device 140 then irradiates the surfaces of the photosensitive drums 120 with light based on image data input to an image input section from a personal computer or the like, thereby forming electrostatic latent images on the surfaces of the respective photosensitive drums 120. Next, toners in respective colors fly by developing bias voltage to adhere to the respective electrostatic latent images formed on the surfaces of the respective photosensitive drums 120, thereby forming toner images in the respective developing devices 130.

The toner images in the respective colors formed on the surfaces of the respective photosensitive drums 120 are primarily transferred in succession to an intermediate transfer belt by respective primary transfer rollers to be layered in color. In this manner, a full-color toner image is formed on the surface of the intermediate transfer belt.

Paper to which the full-color toner image is transferred is conveyed to the fixing device 170. Heat and pressure by a fixing roller fix the toner image to the surface of the paper. In this manner, a full-color image is formed. The paper on which the full color image is formed is then ejected outside the main body of the image forming apparatus 100 by an ejection roller.

The embodiment of the present invention has been described so far with reference to FIGS. 1-5. In the image forming apparatus 100 according to the present invention, degradation of image quality caused due to image deletion in a high humidity environment can be prevented. Note that the present invention is not limited to the above embodiment and various alterations may be made without departing from the spirit and the scope of the present invention.

INDUSTRIAL APPLICABILITY

The present invention can be utilized in the fields of image forming apparatuses that utilize electrophotographic processes (e.g., printers, copiers, and multifunction peripherals).

The invention claimed is:

1. An image forming apparatus that forms an image on a recording medium, comprising:

a substrate;

a photosensitive drum;

a heating element configured to heat the photosensitive drum;

a light emitting element configured to perform static elimination on the photosensitive drum; and a metal member configured to transfer heat from the heating element to the photosensitive drum, wherein the light emitting element and the heating element are mounted on one of main surfaces of the substrate, and the metal member is in contact with another of the main surfaces of the substrate.

2. The image forming apparatus according to claim 1, wherein the metal member has an end part located closest to the photosensitive drum, the substrate has an end part located closest to the photosensitive drum, and the end part of the metal member is disposed closer to the photosensitive drum than the end part of the substrate.

3. The image forming apparatus according to claim 1, wherein the light emitting element and the heating element are turned on and off independently of each other.

4. The image forming apparatus according to claim 1, wherein the light emitting element includes a plurality of light emitting elements, the heating element includes a plurality of heating elements, and the light emitting elements are disposed in parallel to the heating elements on the one of the main surfaces of the substrate.

5. The image forming apparatus according to claim 1, wherein the light emitting element includes a plurality of light emitting elements, the heating element includes a plurality of heating elements, the light emitting elements and the heating elements are disposed in a straight line on the one of the main surfaces of the substrate.

6. The image forming apparatus according to claim 1, comprising a control board including an electricity receiving terminal for input and an electricity receiving terminal for output, wherein the control board and the substrate are independent of and separate from each other.

7. The image forming apparatus according to claim 6, further comprising a limiting resistor configured to adjust electric current to the light emitting element and mounted on the control board.

8. The image forming apparatus according to claim 6, wherein the light emitting element and the heating element are connected on either respective input sides or respective output sides to the control board at a common one of the electricity receiving terminal for input and the electricity receiving terminal for output through common wiring.

9. The image forming apparatus according to claim 1, further comprising a substrate warping restraining member configured to restrain the substrate from warping and disposed on the substrate.

* * * * *